US005706957A

United States Patent [19]

Hardy

[11] Patent Number: 5,706,957

[45] Date of Patent: Jan. 13, 1998

[54] GRAVITY FEED TRACK SYSTEM

[75] Inventor: Stephen N. Hardy, Wadsworth, Ohio

[73] Assignee: RTC Industries, Inc., Chicago, Ill.

[21] Appl. No.: 617,369

[22] Filed: Mar. 18, 1996

[51] Int. Cl.[6] ..... A47F 7/00

[52] U.S. Cl. ..... 211/59.2

[58] Field of Search ..... 211/59.2, 79; 312/42, 312/45; 248/312.1, 222.11, 221.11

[56] References Cited

U.S. PATENT DOCUMENTS 4,310,097 1/1982 Merl ..... 211/74 X
4,318,485 3/1982 Clement ..... 211/59.2
4,367,818 1/1983 Suttles ..... 211/74 X
4,401,221 8/1983 Suttles ..... 211/59.2

FOREIGN PATENT DOCUMENTS

WO 94/10885 5/1994 WIPO ..... 211/74

*Primary Examiner*—Leslie A. Braun
*Assistant Examiner*—Sarah L. Purol
*Attorney, Agent, or Firm*—Dressler, Rockey, Milnamow & Katz, Ltd.

[57] ABSTRACT

A gravity feed merchandise display device including a plurality of downwardly inclined track assemblies that support a row of bottles by its neck flanges. The forwardmost bottle is prevented from exiting its track by a spring mechanism that must be overcome to remove the bottle from the track assembly on which it is located.

13 Claims, 2 Drawing Sheets

GRAVITY FEED TRACK SYSTEM

FIELD OF THE INVENTION

This invention relates to a gravity feed track system, and particularly to such a system that is used in a merchandise display device containing rows of bottles. Such a display device would include a refrigerator cooler in which the bottles are arranged in rows on transversely spaced tracks. The tracks are inclined so that the rows of the bottles will move toward the door of the cooler so they are readily accessible. The invention is applicable to various kinds of display systems with a refrigerated cooler being but one example.

BACKGROUND OF THE INVENTION

Self service display devices are commonly used to provide access to products located therein. In the case of a device such as a cooler used to contain a plurality of refrigerated bottled soft drinks that are to be sold individually they have heretofore been designed to merely locate the bottles on shelves or tracking assemblies that support the bottles and permit their removal by simply taking them off the end of the track device on which they are located. Gravity fed track devices have been used in the past and they have been found to be generally acceptable but subject to various disadvantages. For example, in some of them, the bottles cannot be readily and conveniently removed from the front of the track or when located at the end of the track they are not retained in the proper position relative to the track. It is particularly important that the track mechanisms be designed to accommodate conventional plastic bottles that have a neck ring, which neck ring normally is supported by the track. Also, while the bottles must be retained on the track, the track assembly must be designed to facilitate easy and convenient removal of the bottles from the track assembly. It is important that the bottles can be removed without difficulty and inconvenience to the purchaser. In addition, it is desirable that the track assemblies be designed so that the bottle supply can be readily replenished.

It is to be noted that another application filed on even date entitled "Gravity Feed Dispenser" and assigned to the assignee of the present invention contains many of the same attributes as the present invention but is distinct therefrom.

SUMMARY OF THE INVENTION

In accordance with the present invention, there is provided a novel track assembly that in the illustrated embodiment is utilized in a refrigerated cooler that contains a plurality of such track assemblies. The assemblies are transversely spaced and longitudinally extending and are supported within the cooler so that the track assemblies have a slight downward inclination with the result that the bottles are gravity fed toward the front of the cooler. The tracks include rails that support the neck flanges of the bottles, with the balance of the bottles depending through the opening formed between the track rails.

The front of the track assembly is provided with a resilient means that is sufficiently strong to normally prevent the bottles from exiting from the track until they are pulled forward to overcome the resilient means.

There are various designs of resilient means that can be used for preventing removal of the bottle from the track rails. In one embodiment, a spring steel retainment ring is secured to the top of a tubular track and extends around the tube and inwardly to define a gap that is less than the diameter of the neck of the bottle to prevent the bottle from exiting the track. In another embodiment, there are provided inwardly extending leaf springs secured to the inside of the tube that are spaced apart an amount less than the diameter of the bottle closure to engage the front of the bottle closure to prevent the bottle from being withdrawn. In yet another embodiment, there is provided a leaf spring extending downwardly from the top of the tube which is contacted by the front of the closure to prevent the bottle from being withdrawn.

As aforementioned, the bottles can be removed from the track by overcoming the spring bias imposed by the resilient devices in the various embodiments illustrated.

In addition, it is to be noted that in each of the embodiments, bottles can be readily reloaded on the track rails from the front of the track by inserting the bottle against the action of the particular resilient means employed.

DESCRIPTION OF A PREFERRED EMBODIMENT

Figure 1:
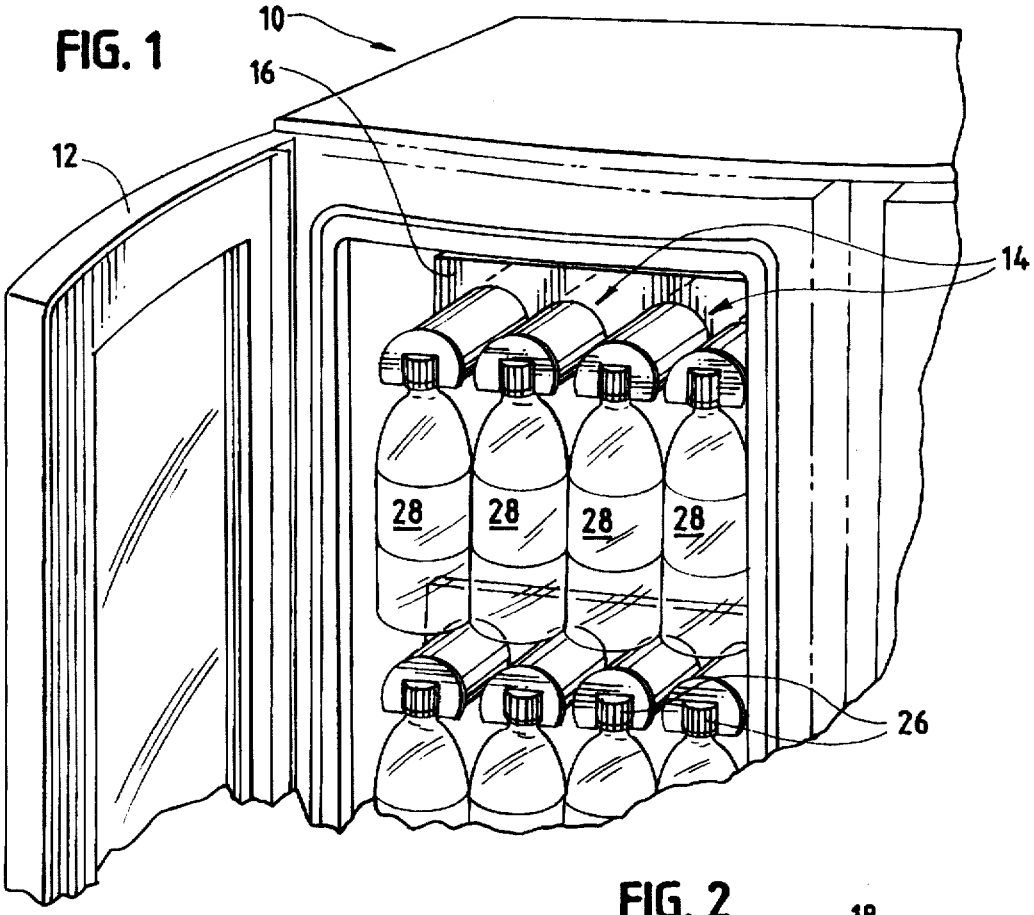
FIG. 1 is a partial perspective view showing a cooler with a plurality of track mechanisms shown retaining rows of bottles.

Referring to FIG. 1, there is shown a refrigerated cooler 10 having an open door 12. Located within the cooler are a plurality of track assemblies 14 that are retained within the cooler 10 by a support member 16 that is fixedly positioned therein. Each of the track assemblies of the various illustrated embodiments consists of a tubular member 18 that is fitted into a recess 20 defined by the support member 16 and suitably secured thereto. The tubular member illustrated is an aluminum extrusion, but this is by way of example only since other track configurations can be used that fall within the scope of the invention as defined by the claims. The tube 18 has an opening 22 on the bottom thereof, which opening is defined by transversely spaced rails 24 extending the full length of the tube 18. Located within the tube 18 is the bottle closure 26 which is threaded onto the finish of the bottle 28 and engages the neck flange 30. The neck flange 30 has a diameter larger than the distance between the rails 24, which neck flange is disposed on the rails 24 and is supported thereby during its movement relative to the track assemblies 14. It should be noted that the tube 18 is disposed at an angle on the order of 5° to 10° relative to the horizontal from front to back, and thus the bottles will be gravity fed toward the front of the cooler as a bottle is removed from the front of a row of bottles in the cooler.

In each of the three illustrated embodiments a resilient stop member is located at the front end of the track assembly to prevent the front bottle in the row from exiting the track.

Figure 2:
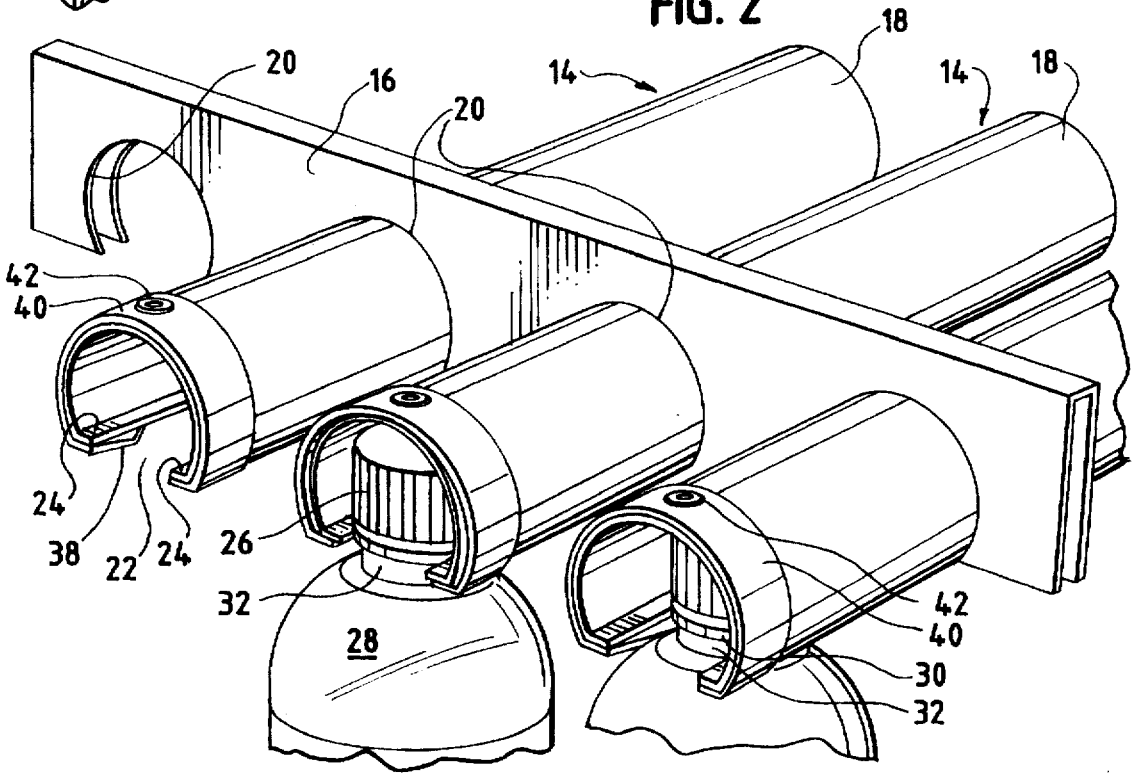
FIG. 2 is a partial perspective view of one embodiment of the track design employing a spring steel retainment ring.

In the normal position as shown at the right in FIG. 2, the front bottle 28 in a row in which the neck flange slides on the rails 24 the front bottle will be restrained from exiting the row by the tapered portion 38 of the spring steel retainment ring 40. The distance between the tips of the tapered portion 38 is less than the diameter of the neck 32 of the bottle, and therefore the bottle is retained in position in the track by the tapered ring portion 38. When it is desired to remove the bottle from the track, the bottle is moved forwardly against the action of the spring ring 40 wherein it will yield by moving outwardly to permit removal of the bottle from the track. It is to be noted that the spring retainment ring 40 is connected to the top of the tube by rivet 42.

Figure 3:
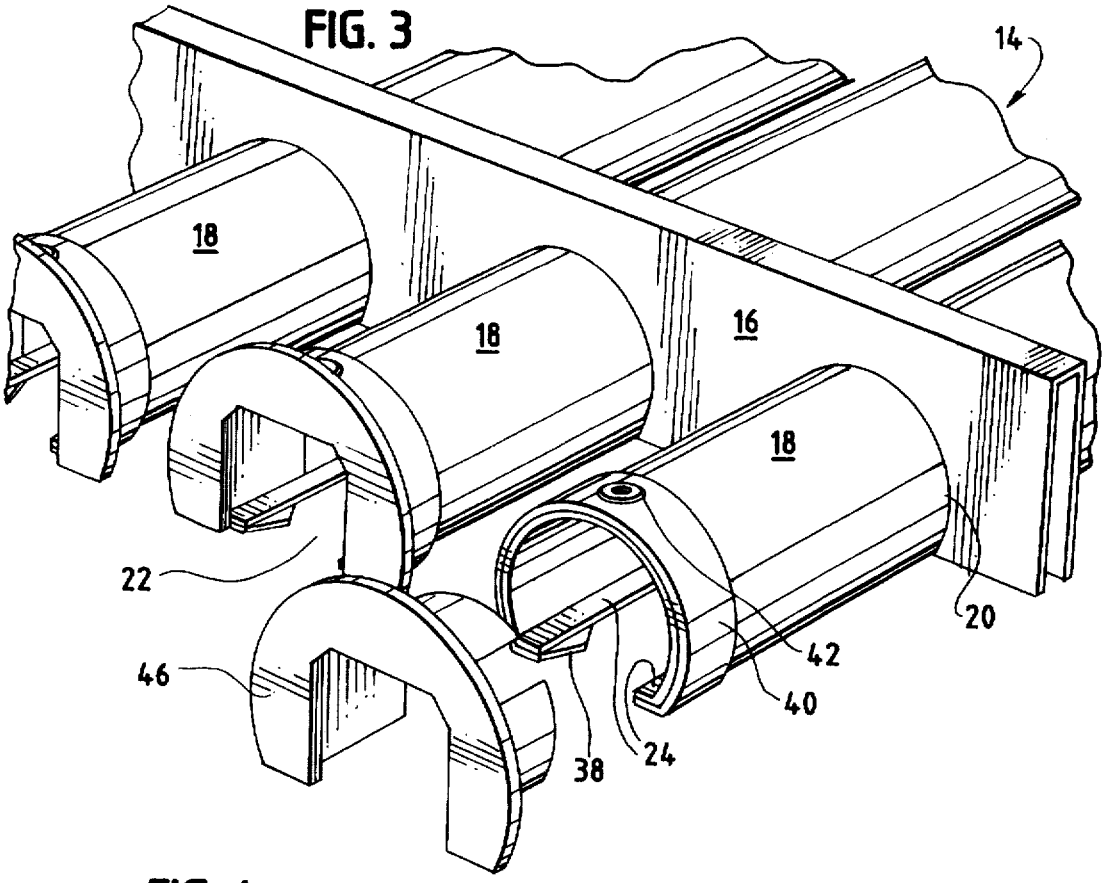
FIG. 3 is a partial perspective view of the embodiment shown in FIG. 2 illustrating an end cap attached thereto.

It remains to note that in order to provide a better appearance, an end cap 46 is inserted into the tube 18 as shown in the middle track assembly in FIG. 3.

Figure 4:
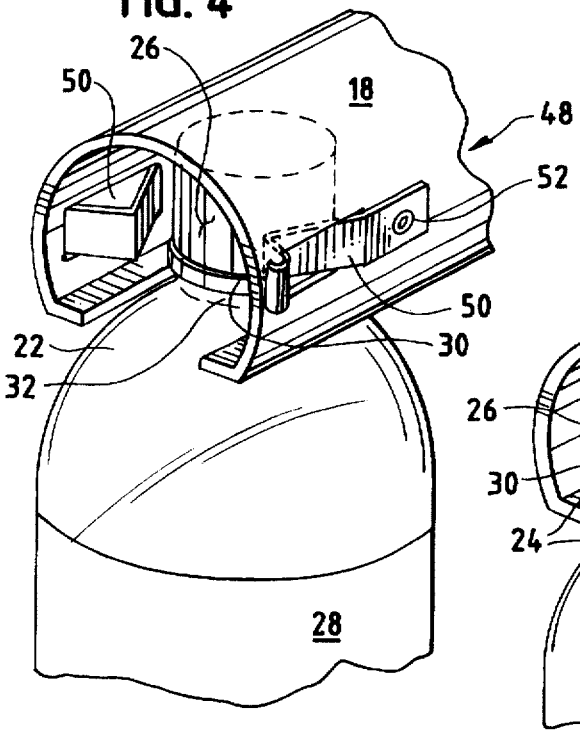
FIG. 4 is a partial perspective view of a second embodiment of the invention.

In a second embodiment of the invention shown in FIG. 4, there is illustrated a track assembly 48 that consists of a tube 18 which includes track rails 24 on which the flanges 30 of the bottles 28 travel during their downward movement with respect to the rails 24. The closure 26 secured to the bottle 28 engages V-shaped leaf springs 50 that extend in from the sidewalls of the tube to prevent the bottle from leaving the track. The spacing between the V-shaped springs is less than the diameter of the closure, with the result that the end bottle will come to rest against the walls of the spring 50. The spring 50 is secured to the sidewalls by rivets 52. As in the embodiment disclosed in FIG. 2, when it is desired to remove the bottle from the track, the bottle is pulled forward, at which time the springs 50 will yield to permit removal.

Figure 5:
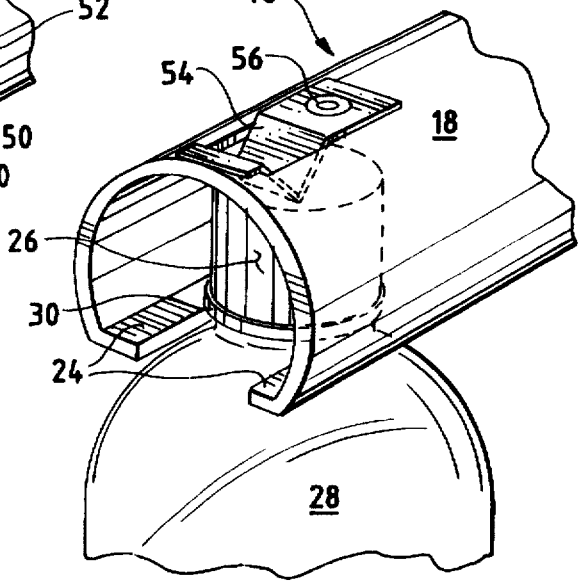
FIG. 5 is a partial perspective view of a third embodiment of the invention.

A further embodiment incorporating applicant's invention is shown in FIG. 5 in which a generally V-shaped leaf spring 54 extends inwardly from the top wall of the tube 18 to contact the closure 26 of the bottle 28 to retain the bottle on the track rails 24. Spring 54 is secured to the top wall by rivet 56. Removal of the end bottle from the track occurs by pulling it forwardly to move spring 54 upwardly out of the way of the closure to remove the bottle from the track.

It is intended to cover by the appended claims all such modifications as all within the true spirit and scope of the invention.

What is claimed is:

1. A gravity feed merchandise display device comprising a track support means, at least one longitudinally extending track assembly secured to said support means having front and rear ends, each track assembly including a pair of transversely spaced apart rails defining an opening, which rails support a row of similar bottles following a lead bottle, each having a closure secured thereto and an annular flange on the neck of the bottle with the underside of each bottle neck flange engaging and supported by the rails for movement relative to said rails, said track support means retaining the track in a downwardly inclined direction toward the front end of the track so the suspended bottles are gravity fed to the front end of the track as the lead bottle in a track is successively unloaded, the front end of each track assembly includes a resiliently biased stop means for said bottle closure defining an opening having height and width dimensions whereby the closure will be prevented from exiting said opening when the bottle is supported by said track assembly, but can be removed from said track through said opening when pulled against said stop means.

2. The gravity feed merchandise display device in accordance with claim 1 in which the resilient means is secured to but disposed below said rails and defines a gap smaller than the diameter of the bottle neck to prevent the removal of a bottle from said track.

3. The gravity feed merchandise display device in accordance with claim 1 in which the track has a tubular configuration and the resilient means comprises a spring retainment ring that is secured to said tubular configuration and extends into the opening defined by said rails.

4. The gravity feed merchandise display device in accordance with claim 1 in which the track has a tubular configuration including sidewalls and the resilient means includes leaf springs extending inwardly from said sidewalls to engage the lead bottle to prevent the bottles from being removed from the track.

5. The gravity feed merchandise display device in accordance with claim 1 in which the track has a tubular configuration including a top wall and the resilient means includes a leaf spring secured to said top wall and extending downwardly to engage a lead bottle to prevent the bottle from being removed from the track.

6. The gravity feed merchandise display device in accordance with claim 1 which includes a plurality of track assemblies and end caps are provided for each track assembly.

7. A track assembly including a pair of transversely spaced apart rails defining an opening, which rails support a row of similar bottles following a lead bottle, each having a closure secured thereto and an annular flange on the neck of the bottle with the underside of each bottle neck flange engaging and supported by the rails for movement relative to said rails, track support means for retaining the track in a downwardly inclined direction toward the front end of the track so the suspended bottles are gravity fed to the front end of the track as the lead bottle in a track is successively unloaded, the front end of each track assembly includes a resiliently biased stop means for said bottle closure which stop means defines an opening having height and width dimensions whereby the closure will be prevented from exiting said opening when the bottle is supported by said track assembly, but can be removed from said track through said opening against the action of said stop means.

8. A track assembly in accordance with claim 7 in which the resilient means is secured to but disposed below said rails and defines a gap smaller than the diameter of the bottle neck to prevent the removal of a bottle from said track.

9. A track assembly in accordance with claim 8 in which the track has a tubular configuration and the resilient means comprises a spring retainment ring that is secured to said tube and extends into the opening defined by said rails.

10. A track assembly in accordance with claim 7 in which the track has a tubular configuration including sidewalls and the resilient means includes leaf springs extending inwardly from said sidewalls to engage the lead bottle to prevent the bottles from being removed from the track.

11. A track assembly in accordance with claim 7 in which the track has a tubular configuration including a top wall and the resilient means includes a leaf spring secured to said top wall and extending downwardly to engage a lead bottle to prevent the bottle from being removed from the track.

12. The gravity feed merchandise display device in accordance with claim 1 in which the track includes sidewalls and the resilient stop means forms a portion of said sidewalls which engage the lead bottle closure to prevent the bottles from being removed from the track.

13. A track assembly in accordance with claim 7 in which the track includes sidewalls and the resilient stop means forms a portion of said sidewalls which engage the lead bottle closure to prevent the bottles from being removed from the track.

* * * * *